US007742733B2

(12) United States Patent
Barton et al.

(10) Patent No.: US 7,742,733 B2
(45) Date of Patent: Jun. 22, 2010

(54) FUSER ASSEMBLIES, XEROGRAPHIC APPARATUSES AND METHODS OF FUSING TONER ON MEDIA

(75) Inventors: Augusto E. Barton, Webster, NY (US); Anthony S. Condello, Webster, NY (US); Donald Bott, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 113 days.

(21) Appl. No.: 12/163,364

(22) Filed: Jun. 27, 2008

(65) Prior Publication Data

US 2009/0324273 A1 Dec. 31, 2009

(51) Int. Cl.
*G03G 15/20* (2006.01)

(52) U.S. Cl. ..... 399/329; 219/216; 399/45; 399/69; 430/124.3

(58) Field of Classification Search ..... 399/329, 399/328, 336, 45, 67, 69; 219/216; 347/156; 430/124.3

See application file for complete search history.

(56) References Cited

U.S. PATENT DOCUMENTS 3,811,828 A * 5/1974 Ohta et al. ..... 219/216 X
6,449,458 B1 * 9/2002 Lang et al. ..... 399/336
6,505,832 B2 1/2003 Moore et al.
2005/0025538 A1 * 2/2005 Omata ..... 399/329
2006/0093418 A1 * 5/2006 Watanabe et al. ..... 399/329
2008/0019745 A1 * 1/2008 Iwaishi et al. ..... 399/336
2008/0095548 A1 * 4/2008 Iwaishi et al. ..... 399/45
2009/0269108 A1 * 10/2009 Condello et al. ..... 399/329

FOREIGN PATENT DOCUMENTS

JP 04-050842 A * 2/1992
JP 2005-049681 A * 2/2005
JP 2007-248664 A * 9/2007

* cited by examiner

*Primary Examiner*—Sophia S Chen
(74) *Attorney, Agent, or Firm*—Edward A. Brown; Prass LLP

(57) ABSTRACT

Fuser assemblies, xerographic apparatuses, and methods of fusing toner on media in xerographic apparatuses are disclosed. An embodiment of the fuser assemblies includes a fuser belt having an inner surface and an outer surface opposite the inner surface, at least a first roll and a second roll supporting the fuser belt, and a radiant heater facing the inner surface of the fuser belt. The radiant heater is adapted to emit radiant heat onto the inner surface of the fuser belt to increase the temperature of the outer surface of the fuser belt opposite the inner surface heated by the radiant heater.

20 Claims, 8 Drawing Sheets

FUSER ASSEMBLIES, XEROGRAPHIC APPARATUSES AND METHODS OF FUSING TONER ON MEDIA

BACKGROUND

Fuser assemblies, xerographic apparatuses, and methods of fusing toner on media in xerographic processes are disclosed.

In a typical xerographic printing process, a toner image is formed on a medium, and then the toner is heated to fuse the toner on the medium. One process for thermally fusing toner onto media uses a fuser assembly including a pressure roll, a fuser roll, a nip between these rolls, and a rotatable fuser belt positioned between these rolls. During the fusing process, a medium with a toner image is fed to the nip, where heat and pressure are applied to the medium to fix the toner image to the medium.

It would be desirable to provide fuser assemblies including fuser belts that can provide energy-efficient operation when used for mixed-media print jobs.

SUMMARY

According to aspects of the embodiments, fuser assemblies for fusing toner on media in xerographic apparatuses, xerographic apparatuses and methods of fusing toner on media in xerographic apparatuses are disclosed. An exemplary embodiment of the fuser assemblies comprises a fuser belt including an inner surface and an outer surface opposite the inner surface, at least a first roll and a second roll supporting the fuser belt, and a radiant heater facing the inner surface of the fuser belt. The radiant heater is adapted to emit radiant heat onto the inner surface of the fuser belt to increase the temperature of the outer surface of the fuser belt opposite the inner surface heated by the radiant heater.

DRAWINGS

Figure 7:
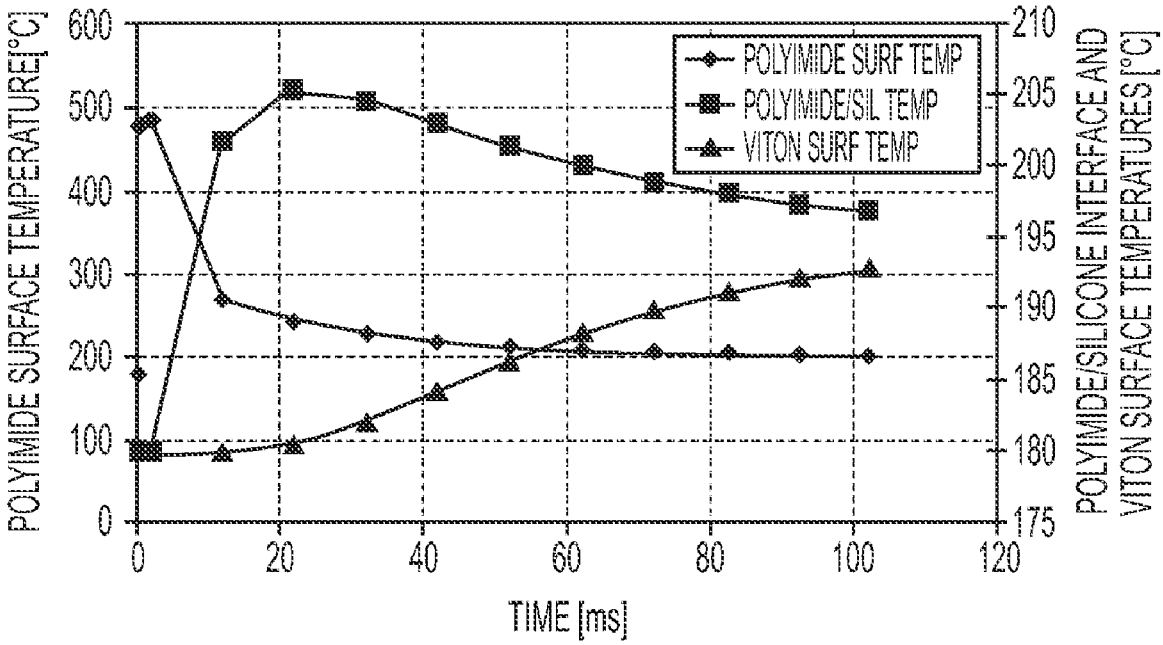

FIG. 7 shows temperature versus time curves for different locations of an exemplary fuser belt including an inner layer forming an inner surface of the fuser belt, an intermediate layer on the inner layer, and an outer layer on the intermediate layer and forming an outer surface of the fuser belt. The fuser belt is heated at the inner surface by radiant heat having a first energy density over a first time duration. The temperatures are calculated for the outer surface (◆), the inner layer/intermediate layer interface (■), and the outer surface (▲).

Figure 8:
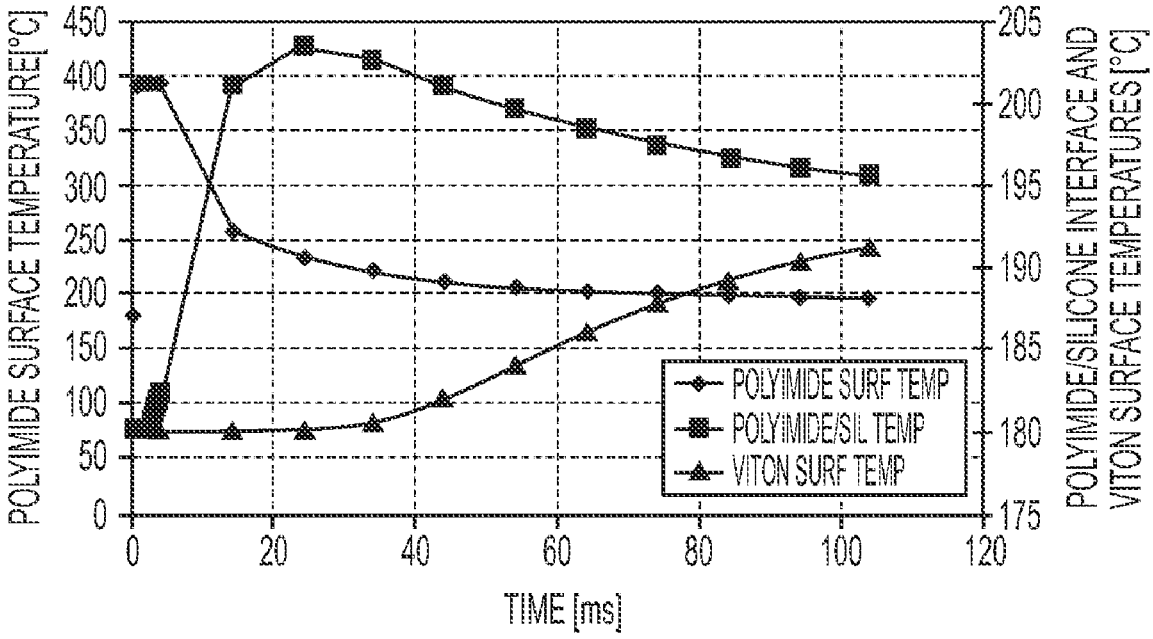

FIG. 8 shows calculated temperature versus time curves determined for the same locations as those of the fuser belt used for the curves shown in FIG. 7. The curves shown in FIG. 8 are calculated for heating the fuser belt at the inner surface with radiant heat having the same first energy density over a second time duration larger than the first time duration.

DETAILED DESCRIPTION

The disclosed embodiments include a fuser assembly including a fuser belt including an inner surface and an outer surface opposite the inner surface, at least a first roll and a second roll supporting the fuser belt, and a radiant heater facing the inner surface of the fuser belt. The radiant heater is adapted to emit radiant heat onto the inner surface of the fuser belt to increase the temperature of the outer surface of the fuser belt opposite the inner surface heated by the radiant heater.

The disclosed embodiments further include a fuser assembly including a fuser belt including an inner surface and an outer surface opposite the inner surface; at least a first roll and a second roll supporting the fuser belt, the first roll and second roll being adapted to heat the fuser belt; a third roll; a nip defined between the second roll and third roll; and a radiant heater including a plurality of flash lamps facing the inner surface of the fuser belt between the first roll and second roll. The flash lamps are adapted to emit radiant heat onto the inner surface of the fuser belt to increase the temperature of the outer surface of the fuser belt opposite the inner surface heated by the flash lamps.

The disclosed embodiments further include a method of fusing toner onto a medium in a xerographic apparatus comprising a fuser belt including an inner surface and an outer surface opposite the inner surface. The method comprises heating at least a portion of the inner surface of the fuser belt using a radiant heater that emits radiant heat onto the inner surface; and contacting a first medium having a first toner thereon with a portion of the outer surface of the fuser belt opposite the portion of the inner surface heated by the radiant heater so as to heat the first toner to a first temperature effective to fuse the first toner onto the first medium.

Figure 1:
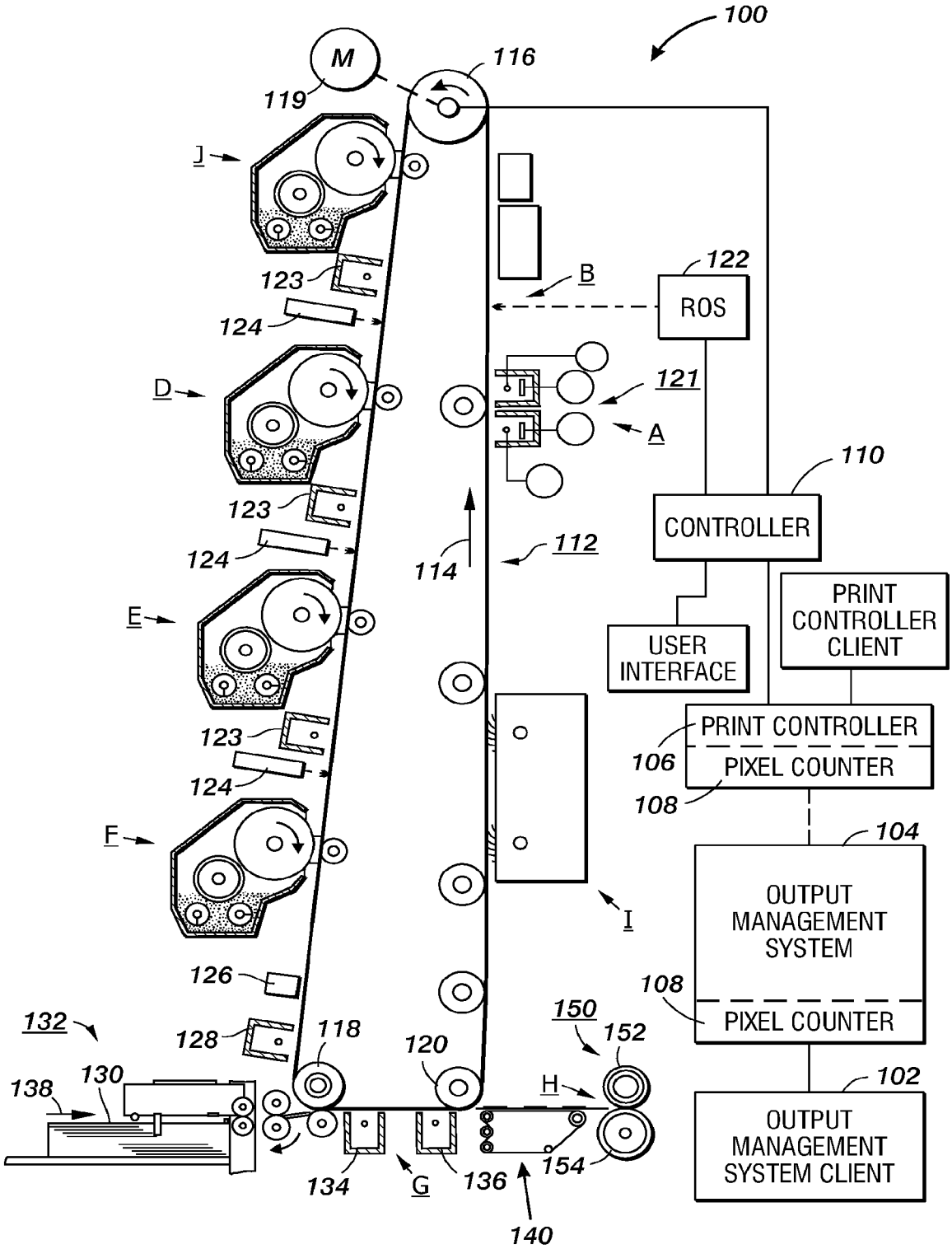
FIG. 1 illustrates an exemplary embodiment of a xerographic apparatus.

FIG. 1 illustrates an exemplary xerographic apparatus in which embodiments of the disclosed fuser assemblies can be used. Such digital imaging systems are disclosed in U.S. Pat. No. 6,505,832, which is hereby incorporated by reference in its entirety. The imaging system is used to produce an image, such as a color image output in a single pass of a photoreceptor belt. It will be understood, however, that embodiments of the fuser assemblies can be used in other imaging systems. Such systems include, e.g., multiple-pass color process systems, single or multiple pass highlight color systems, or black and white printing systems.

As shown in FIG. 1, printing jobs are sent from an output management system client 102 to an output management system 104. The output management system 104 supplies printing jobs to a print controller 106. A pixel counter 108 in the output management system 104 counts the number of pixels to be imaged with toner on each sheet or page of the print job, for each color. The pixel count information is stored in the memory of the output management system 104. Job control information is communicated from the print controller 106 to a controller 110.

The xerographic apparatus 100 includes a continuous (endless) photoreceptor belt 112 supported on a drive roll 116 and rolls 118, 120. The drive roll 116 is connected to a drive motor 119. The drive motor 119 moves the photoreceptor belt 112 in the direction of arrow 114 through the xerographic stations A to I shown in FIG. 1.

During the printing process, the photoreceptor belt 112 passes through a charging station A. This station includes a corona generating device 121 for charging the photoconductive surface of the photoreceptor belt 112.

Next, the charged portion of the photoconductive surface of the photoreceptor belt 112 is advanced through an imaging/exposure station B. At this station, the controller 110 receives image signals from the print controller 106 representing the desired output image, and converts these signals to signals transmitted to a laser raster output scanner (ROS) 122. The photoreceptor belt 112 undergoes dark decay. When exposed at the exposure station B, the photoreceptor belt 112 is discharged, resulting in the photoreceptor belt 112 containing charged areas and discharged or developed areas.

At a first development station J, charged toner particles, e.g., black particles, are attracted to the electrostatic latent image on the photoreceptor belt 112. The developed image is conveyed past a charging device 123 at which the photoreceptor belt 112 and developed toner image areas are recharged to a predetermined level.

A second exposure/imaging is performed by device 124. The device selectively discharges the photoreceptor belt 112 on toned areas and/or bare areas, based on the image to be developed with the second color toner. At this point of the process, the photoreceptor belt 112 contains areas with toner and areas without toner at relatively high voltage levels, as well as at relatively low voltage levels. These low voltage areas represent image areas. At a second developer station D, a negatively-charged developer material comprising, e.g., yellow toner, is transferred to latent images on the photoreceptor belt 112 using a second developer system.

The above procedure is repeated for a third image for, e.g., magenta toner, at station E, using a third developer system, and for a fourth image and color toner, e.g., cyan toner, at station F, using a fourth developer system. This procedure develops a full-color composite toner image on the photoreceptor belt 112. A mass sensor 126 measures the developed mass per unit area.

In cases where some toner charge is totally neutralized, or the polarity reversed, a negative pre-transfer dicorotron member 128 can condition the toner for transfer to a medium using positive corona discharge.

In the process, a medium 130 (e.g., a length of paper) is advanced to a transfer station G by a feeding apparatus 132. The medium 130 is brought into contact with the photoreceptor belt 112 in a timed sequence so that the toner powder image developed on the photoreceptor belt 112 contacts the advancing medium 130.

The transfer station G includes a transfer dicorotron 134 for spraying positive ions onto the backside of the medium 130. The ions attract the negatively-charged toner powder images from the photoreceptor belt 112 to the medium 130. A detack dicorotron 136 facilitates stripping of media from the photoreceptor belt 130.

After the toner image has been transferred, the medium continues to advance, in the direction of arrow 138, onto a conveyor 140. The conveyor 140 advances the medium to a fusing station H. The fusing station H includes a fuser assembly 150 for permanently affixing, i.e., fusing, the transferred powder image to the medium 130. The fuser assembly 150 includes a heated fuser roll 152 and a pressure roll 154. The medium 130 is advanced between the fuser roll 152 and pressure roll 154 with the toner powder image contacting the fuser roll 152 to permanently affix the toner powder images to the medium 130. The medium 130 is then guided to an output device (not shown) for subsequent removal from the apparatus by the operator.

After the medium 130 has been separated from the photoreceptor belt 112, residual toner particles on non-image areas on the photoconductive surface of the photoreceptor belt 112 are removed from the photoconductive surface at a cleaning station 1.

Xerographic apparatuses, such as the apparatus 100, can be used for performing print jobs where all media are of the same type (e.g., same thickness and weight), and for mixed-media print jobs. A mixed-media print job can consist of media having different thicknesses (weights). The media can be coated or uncoated. For example, a mixed-media print job can include different combinations of thin/uncoated, thin/coated, thick/uncoated and thick/coated paper media. Each type of media typically has its own optimum set temperature for achieving a desired gloss and toner fix during the fusing step. The amount of thermal energy that needs to be supplied to thicker media to fuse toner on them exceeds the amount of heat that needs to be supplied to thinner media of the same material to fuse the same toner on the thinner media. More energy is also needed to affix toner on coated media than on uncoated media. These different characteristics of different media increase the difficulty of achieving full productivity and image quality consistency in mixed-media print jobs.

When using a fuser assembly including a fuser belt supported on heated rolls, to print different types of media in a single print job, the temperature of the fuser belt can be changed during the print job. For example, toner can be fused on thin media at a first temperature set point of the fuser belt. To then heat thick media in the print job to a sufficiently-high temperature to fuse toner on the thick media, the temperature of the fuser belt can be increased from the first temperature set point to a higher second temperature set point. Increasing the temperature of the fuser belt to such a higher temperature set point during a print job requires increasing the amount of heat supplied to the fuser belt by the heated rolls of the fuser assembly supporting the fuser belt. However, due to the thermal mass of the heated rolls, it can take, e.g., 30 seconds or more, to heat the fuser belt from the first temperature set point to the higher, second temperature set point by increasing the temperature of the rolls. Consequently, this approach introduces a significant time delay in the printing job.

To avoid such time delays in mixed-media print jobs (e.g., a print job including at least one thick medium mixed with thin media), the xerographic apparatus can be programmed to begin to increase the amount of heat supplied to the fuser belt before the thick medium is printed. During this heat-up period, when the apparatus continues to print thin media included in the print job, these thin media can be over-fused by being heated to a temperature above the temperature set point for thin media. Consequently, the printed thin media can have defects, such as different gloss from sheet-to-sheet, hot offset, and possible mis-strip.

Figure 2:
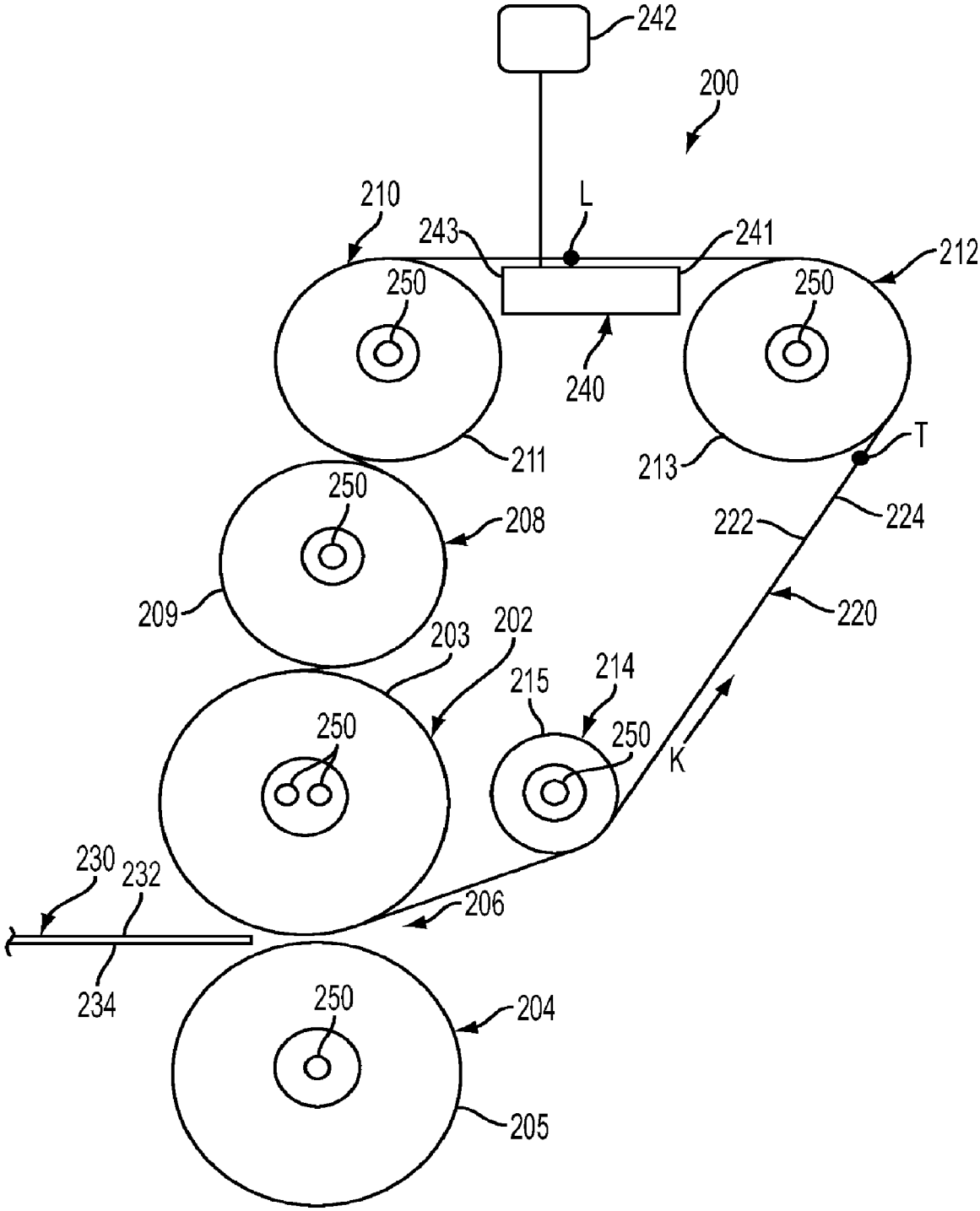
FIG. 2 illustrates an exemplary embodiment of a fuser assembly including a radiant heater.

FIG. 2 illustrates a fuser assembly 200 according to an exemplary embodiment. The fuser assembly 200 is constructed to provide more thermally-efficient fusing of toner on media in mixed-media print jobs. Desirably, the fuser assembly 200 can be used for mixed-media print jobs without over-fusing of media. The fuser assembly 200 can be used in different types of xerographic apparatuses. For example, the fuser assembly 200 can be incorporated in the xerographic apparatus 100 shown in FIG. 1, in place of the fuser assembly 150.

Embodiments of the fuser assembly include at least two rolls supporting a fuser belt. At least one roll supporting the fuser belt is driven to rotate by a drive mechanism connected to the roll. The fuser assembly 200 shown in FIG. 2 includes a fuser roll 202, a pressure roll 204, and a nip 206 between the fuser roll 202 and pressure roll 204. The fuser assembly 200 also includes idler rolls 208, 210, 212 and 214. As shown, the idler rolls 208, 210, 212 and 214 can have different diameters from each other. Other embodiments of the fuser assembly can include a different number of idler rolls. An endless (continuous) fuser belt 220 is supported on the fuser roll 202 and on the idler rolls 208, 210, 212, 214. The fuser belt 220 has an inner surface 222 and an outer surface 224 opposite to the inner surface 222. The fuser belt 220 is driven by the drive mechanism to rotate in the counter-clockwise direction shown by arrow K. Typically, the fuser belt 220 can be driven at a speed of about 200 mm/s to about 1000 mm/s by the drive mechanism.

In the fuser assembly 200, the fuser roll 202 and the idler rolls 208, 210, 212, 214 are heated. As shown, the fuser roll 202 and idler rolls 208, 210, 212, 214 can be heated internally by heating elements 250. The fuser roll 202 and idler rolls 208, 210, 212, 214 include a cylindrical hollow core, and the heating elements 250 can be, e.g., tungsten quartz lamps, quartz rods or the like, extending axially along the core. The respective heating elements 250 are powered by at least one power supply to heat the outer surface 203 of the fuser roll 202, the outer surface 209 of the idler roll 208, the outer surface 211 of the idler roll 210, the outer surface 213 of the idler roll 212, and the outer surface 215 of the idler roll 214. The fuser roll 202 and the idler rolls 208, 210, 212, 214 heats the inner surface 222 of the fuser belt 220. The amount of heat that is supplied to the fuser belt 220 by the fuser roll 202 and idler rolls 208, 210, 212, 214 is based on the temperature set point for the fuser belt 220, which is based on the characteristics of media to be printed.

An exemplary embodiment of the fuser belt 220 comprises a base layer of polyimide, or like polymer; an intermediate layer of silicone, or the like, on the base layer; and an outer layer comprised of a fluoroelastomer sold under the trademark Viton® by DuPont Performance Elastomers, L.L.C., or a like polymer, on the intermediate layer. The base layer forms the inner surface 222 of the fuser belt 220, and the outer layer forms the outer surface 224. Typically, the base layer has a thickness of about 50 μm to about 100 μm, the intermediate layer has a thickness of about 200 μm to about 400 μm, and the outer layer has a thickness of about 20 μm to about 40 μm. The fuser belt 220 typically has a width of about 350 mm to about 450 mm.

In embodiments of the fuser assembly 200, the fuser belt 220 has a length of at least about 500 mm, about 600 mm, about 700 mm, about 800 mm, about 900 mm, about 1000 mm, or even longer. The primary failure modes of belt fusers are typically attributed to the life of the fuser belt. By using a longer fuser belt for some embodiments of the fuser belt 220, the fuser belt 220 has a larger surface area for wear than shorter belts and, consequently, can have a longer service life.

During operation of the fuser assembly 200, a medium 230 with at least one toner image (e.g., text and/or non-text image) on the surface 232 is fed to the nip 206 by a media feeding apparatus, such as the feeding apparatus 132 shown in FIG. 1. At the nip 206, the outer surface 224 of the rotating fuser belt 220 contacts the surface 232 of the medium 230, and the opposite surface 234 of the medium 230 contacts the surface 205 of the pressure roll 204. The fuser belt 220 and pressure roll 204 apply sufficient heat and pressure to the medium 230 to fuse the toner image on the surface 232. The fusing temperature for fusing the toner on the medium 230 is based on various factors, such as the thickness of the medium, and whether the medium is coated or uncoated. Typically, the fusing temperature ranges from about 150° C. to about 210° C., depending on the media characteristics and printing rate.

The fuser assembly 200 includes a radiant heater 240 for heating the fuser belt 220 by radiant heat transfer. The radiant heater 240 is connected to a heater controller 242 for controlling the operation of the radiant heater 240. The radiant heater 240 is located inside the inner perimeter of the fuser belt 220 defined by the inner surface 222 of the fuser belt 220, and spaced from the inner surface 222. The radiant heater 240 is operable to emit heat onto a portion of the fuser belt 220 before this portion is rotated to the nip 206 and brought into contact with the medium 230. When thin media (i.e., light-weight media, such as a thin sheet of paper) are fused using the fuser assembly 200, and a thick medium (i.e., a heavy-weight medium, such as a thick sheet of paper) is to then be printed, the radiant heater 240 can be powered to heat the portion of the fuser belt 220 that is used to contact and fuse the heavy-weight medium. The radiant heater 240 can produce a well-defined, hotter portion of the fuser belt 220 exclusively for heating the heavy-weight medium at the nip 206. The remaining length of the fuser belt 220 that is not heated by the radiant heater 240, but is heated by the heated rolls, stays at about the lower temperature set point for the light-weight media. The fuser belt 220 can be heated more efficiently using the radiant heater 240 when the fuser assembly 200 is used for multi-media print jobs as compared to heating the fuser belt 220 only with the heated rolls.

The radiant heater 240 includes an upstream end 241 and a downstream end 243. In embodiments, the radiant heater 240 includes at least one radiant energy source that emits radiant heat onto the fuser belt 220. The radiant heat emitted by the radiant energy source(s) heat(s) a portion of the fuser belt 220 to a desired temperature. The radiant energy source can be any suitable source that can emit an effective amount of radiant heat onto the inner surface 222 of the fuser belt 220, within the desired period of time, to heat the desired portion of the outer surface 224 of the fuser belt 220 to the desired temperature.

In some embodiments, the radiant energy source of the radiant heater 240 is at least one flash lamp. Flash lamps are able to emit a high-energy density for short time durations. In embodiments, the flash lamps are able to supply a total energy density of about 2,000 J/m$^2$ to about 12,000 J/m$^2$. The respective flash lamps of the radiant heater 240 can typically discharge this energy density within a period of less than about 10 ms, such as about 4 ms or less, or about 2 ms or less.

Figure 4:
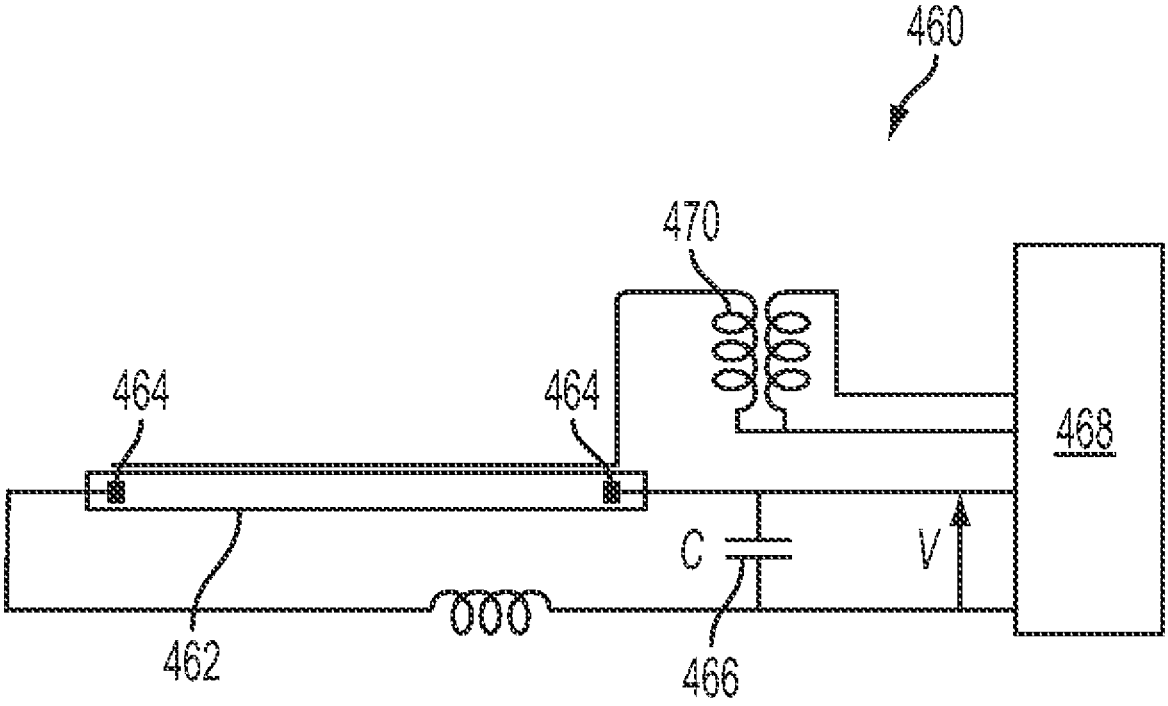
FIG. 4 illustrates an exemplary embodiment of a flash lamp electrical circuit that can be used in embodiments of the radiant heater of the fuser assembly.

FIG. 4 shows an embodiment of a flash lamp electrical circuit 460 that can be used, e.g., in the radiant heater 240. The radiant heater 240 including one or more of the flash lamp electrical circuits 460 can rapidly increase the temperature of the outer surface 224 of the fuser belt 220 along a selected length of the fuser belt 220 that the radiant heater 240 is used to heat. As shown in FIG. 4, the flash lamp electrical circuit 460 includes a tube 462 filled with gas. The gas can be a mixture containing xenon, or any other suitable mixture. The flash lamp electrical circuit 460 includes an electrode 464 at each end. The electrodes 464 are connected to a capacitor 466. A power supply 468 is connected to the capacitor 466 and the electrodes 464. The flash lamp electrical circuit 460 also includes a trigger coil 470. The trigger coil 470 is energized to initially generate an ionization pulse to ionize the gas mixture. A high voltage is stored on the capacitor 466 to allow the rapid delivery of high electrical current to the ionized gas mixture when the flash lamp electrical circuit 460 is triggered. This high current energizes the gas mixture to produce high-intensity light. In the radiant heater, this light impinges upon the inner surface 222 of the fuser belt 220 adjacent to the flash lamp electrical circuit 460.

Figure 5:
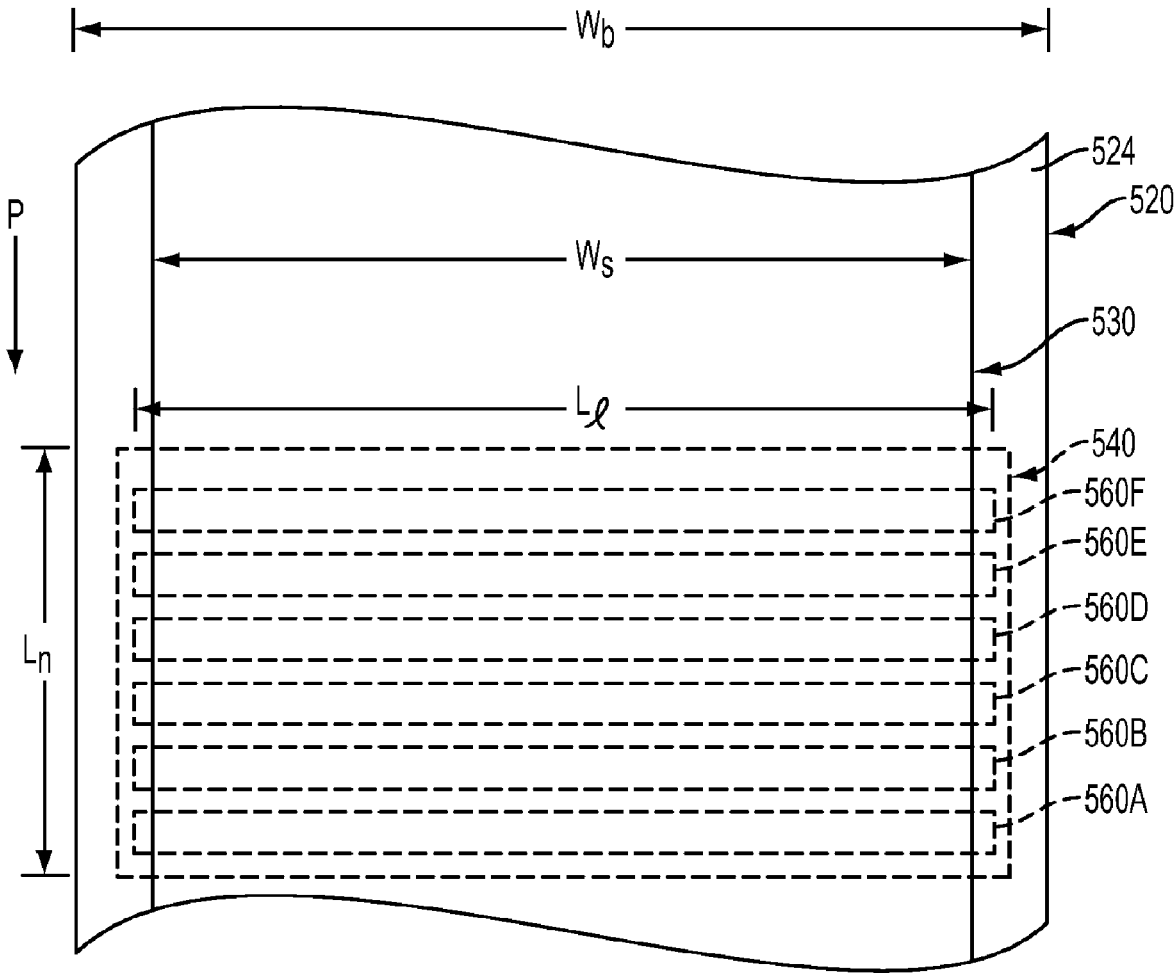
FIG. 5 illustrates an exemplary embodiment of a radiant heater disposed along an inner surface of a fuser belt and a medium supported on an outer surface of the fuser belt.

FIG. 5 shows an embodiment of the radiant heater 540 including six flash lamps 560A, 560B, 560C, 560D, 560E and 560F extending parallel to each other. FIG. 5 shows a medium 530 supported on an outer surface 524 of a fuser belt 520. The medium 530 has a width $W_s$. Other embodiments of the radiant heater 540 can include from one up to at least ten flash lamps. The number of flash lamps in the radiant heater 540 can be determined by the desired heating capacity of the radiant heater 540. For a given flash lamp density, increasing the number of such flash lamps can increase the total heating capacity of the radiant heater 540.

The number of flash lamps included in the radiant heater can also depend on size constraints within the fuser assembly. As shown in FIG. 5, when the radiant heater 540 is installed in a fuser assembly, the flash lamps 560A, 560B, 560C, 560D, 560E and 560F are typically oriented to extend along the width dimension, $W_b$, of the fuser belt 520 (i.e., axially), approximately perpendicular to the process direction (i.e., length dimension) of the fuser belt 520, indicated by the arrow P. In this arrangement of the flash lamps, increasing the number of the flash lamps increases the length, $L_n$, of the radiant heater 540 and, accordingly, increases the length of the space within the fuser assembly needed to contain the radiant heater. In embodiments, adjacent flash lamps, such as the flash lamps in the pairs of the flash lamps 560A, 560B; 560B, 560C; 5600, 560D; 560D, 560E, and 560E, 560F can typically be spaced from each other by about 20 mm to about 50 mm in the length dimension of the radiant heater.

In embodiments, the flash lamps have a length exceeding the width of media that are fused with the fuser assembly, so that the entire width of the media can be effectively heated with the radiant heater. For example, as shown in FIG. 5, the flash lamps 560A, 560B, 5600, 560D, 560E and 560F each have a length, $L_l$, that exceeds the width $W_s$ of the medium 530 and is less than the width, $W_b$, of the fuser belt 520. In embodiments, the flash lamps 560A, 560B, 5600, 560D, 560E and 560F can have the same length, as shown. In other embodiments, at least one of the flash lamps 560A, 560B, 5600, 560D, 560E and 560F can have a different length than the other flash lamps. For example, the flash lamps 560A, 560C and 560E can have the same length (e.g., about 11 inches), and the flash lamps 560B, 560D and 560F can have the same length (e.g., about 14 inches).

In embodiments, at least one of the flash lamps of the radiant heater can be triggered to emit radiant heat at a different time than the other flash lamps. For example, in the radiant heater 540, the flash bulbs 560A, 560C and 560E can be triggered under the control of the controller 542 to emit radiant heat at a time, t, and the other flash bulbs 560B, 560D and 560F can be triggered to emit radiant heat at a later time, $t+\Delta t$. In another embodiment, the flash bulb 560A can be triggered under the control of the controller 542 to emit radiant heat at time, t; the flash bulb 560B can be triggered to emit radiant heat at time $t+\Delta t$; the flash bulb 560C can be triggered to emit radiant heat at time $t+2\Delta t$; the flash bulb 560D can be triggered to emit radiant heat at time $t+3\Delta t$; the flash bulb 560E can be triggered to emit radiant heat at time $t+4\Delta t$, and the flash bulb 560F can be triggered to emit radiant heat at time $t+5\Delta t$. The time lag, $\Delta t$, between when the respective groups of flash lamps, or individual flash lamps, are triggered to emit radiant heat can be, e.g., about 5 ms to about 200 ms. By emitting radiant heat from different groups of flash lamps of the radiant heater at different times, instead of triggering all of the flash lamps at the same time, the rate at which heat is supplied to the fuser belt can be controlled to protect the inner layer of the fuser belt from being exposed to an excessively-high temperature that may damage the material of this layer.

In addition, by staggering the times at which different flash lamps of the radiant heater are triggered, the total length of the fuser belt that can be heated by the flash lamps can be increased as compared to embodiments in which all of the flash lamps are triggered at the same time.

Figure 6:
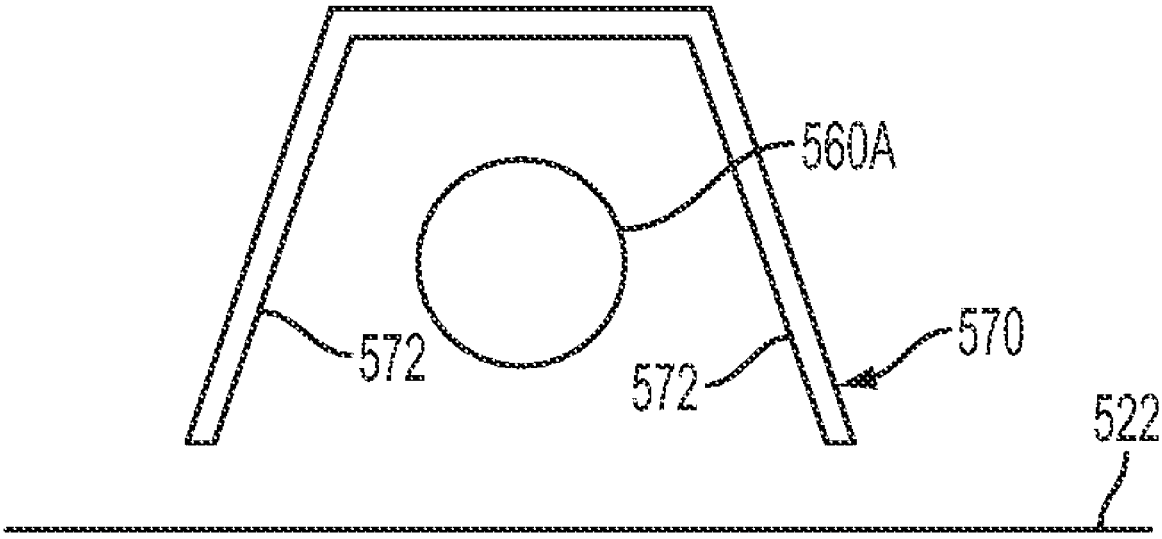
FIG. 6 shows an exemplary embodiment of a radiant heater including a reflector.

FIG. 6 shows the flash lamp 560A with an exemplary reflector 570. The flash lamp 560A is positioned to emit radiant heat onto the inner surface 522 of a fuser belt. The reflector 570 includes angled surfaces 572 for reflecting radiant heat emitted by the flash lamp 560A. The angles of the surfaces 572 with respect to the inner surface 522 can be varied to change the area of the inner surface 522. The other flash lamps 560B, 560C, 560D, 560E and 560F can also include a reflector having the same structure as the reflector 570.

In embodiments, the radiant heater is arranged in the fuser assembly and configured to heat a desired length of the fuser belt facing the radiant heater. The heated length of the fuser belt can be about the length of a medium, such as a thick and/or coated medium. In embodiments, the radiant heater is located along the fuser belt at a location where there is sufficient space between adjacent rolls supporting the fuser belt to accommodate the radiant heater. In embodiments of the radiant heater, the size of the radiant heater determines suitable locations for placing the radiant heater along the inner surface of the fuser belt.

In the fuser assembly 200 shown in FIG. 2, the radiant heater 240 is located between the idler roll 210 and the idler roll 212. The radiant heater 240 is operable to emit radiant heat onto the inner surface 222 of a portion of the fuser belt 220 as that portion moves between the idler roll 212 and the idler roll 210.

Figure 3:
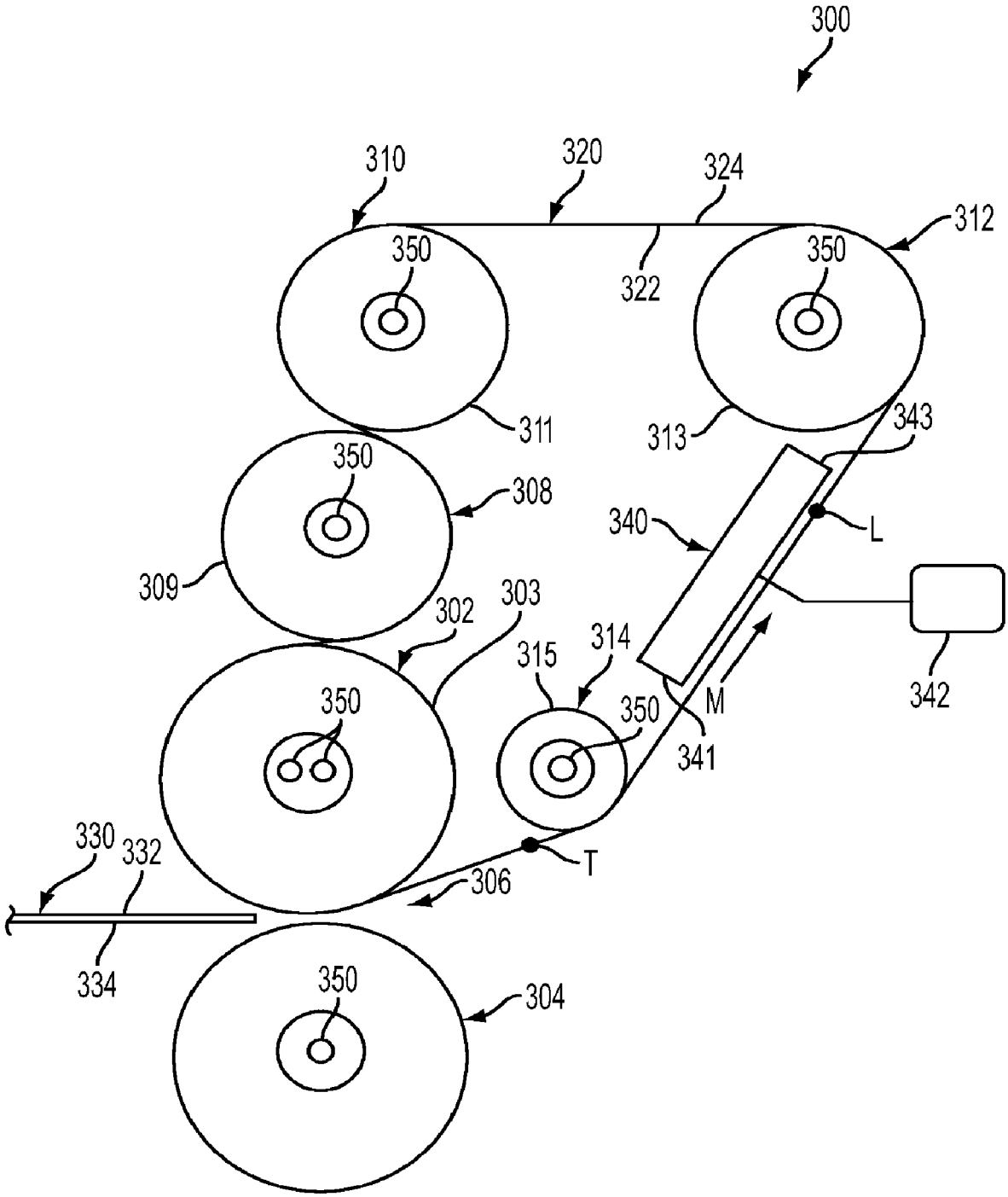
FIG. 3 illustrates another exemplary embodiment of a fuser assembly including a radiant heater.

FIG. 3 shows a fuser assembly 300 according to another embodiment. The fuser assembly 300 includes a fuser roll 302; a pressure roll 304; a nip 306 between the fuser roll 302 and pressure roll 304; idler rolls 308, 310, 312, 314; and an endless (continuous) fuser belt 320 supported on the fuser roll 302 and the idler rolls 308, 310, 312, 314. As shown in FIG. 3, the fuser roll 302, pressure roll 304 and idler rolls 308, 310, 312, 314 can have the same arrangement as in the fuser assembly 200. The medium 330 including opposed surfaces 332, 334 is shown entering the nip 306.

The fuser assembly 300 also includes a radiant heater 340 located between the idler roll 312 and the idler roll 314. The radiant heater 340 includes an upstream end 341 and a downstream end 343. The radiant heater 340 is connected to a heater controller 342 for controlling the operation of the radiant heater 340. The fuser belt 320 is driven to rotate in the counter-clockwise direction of arrow M by a stepper motor, or another suitable mechanism (not shown).

In the fuser assembly 300, the fuser roll 302 and the idler rolls 308, 310, 312, 314 are internally heated by heating elements 350. The respective heating elements 350 of the rolls are powered by at least one power supply to heat the outer surface 303 of the fuser roll 302, the outer surface 309 of the idler roll 308, the outer surface 311 of the idler roll 310, the outer surface 313 of the idler roll 312, and the outer surface 315 of the idler roll 314. The fuser roll 302 and the idler rolls 308, 310, 312, 314 are adapted to heat the inner surface 322 of the fuser belt 320.

The sharpness of the temperature profile for the portion of the fuser belt heated by the radiant heater, in the process direction of the fuser belt (i.e., the direction of arrow K in FIG. 2 and arrow M in FIG. 3), depends on the time response of the radiant heat source of the radiant heater. Flash lamps can produce a sharp temperature profile due to emitting a high energy density over a short amount of time. Other types of radiant heat sources, such as incandescent lamps, produce a less sharp temperature profile along the portion of the fuser belt heated by these lamps.

Typically, the distance between the idler rolls 210, 212 (and between the idler rolls 310, 312) is about 90 mm to about 110 mm, and the distance between the idler rolls 312, 314 (and between the idler rolls 212, 214) is about 160 mm to about 180 mm. These distances are measured from the centers of the idler rolls 210, 212 (and the idler rolls 310, 312), and the centers of the idler rolls 212, 214 (and the idler rolls 312, 314). The distance between portions of the fuser belt 220 that are brought into contact with successively-printed media (i.e., the inter-document-zone of the fuser belt) is typically at least 100 mm, which allows sufficient time to accommodate the time response of flash lamps, e.g., about 4 ms.

The fuser belt 200 is heated from the inner surface 222 to avoid heating the outer surface 224 to an excessively-high temperature. For example, polyimide can typically withstand temperatures up to about 530° C., while Viton® can typically withstand temperatures up to about 200° C. When the fuser belt 220 is heated from the inner surface 222 (i.e., polyimide side), then the temperature of the inner surface 222 will increase quickly due to the high energy density provided by flash fusing in a short time.

In embodiments, the heated rolls of the fuser assembly are able to supply a sufficient amount of power to the fuser belt to fuse toner on thin media (e.g., thin media). The radiant heater has a sufficient heating capacity to be able to supply the entire additional amount of power needed to fuse toner on thick media (i.e., the difference between the amount of power needed to fuse toner on thick media and on thin media), or the additional amount of power needed to fuse toner on coated media (i.e., the difference between the amount of power needed to fuse toner on coated media and un-coated media). By using the radiant heater to supply the additional amount of power, toner can be fused on thick media and/or coated media without having to increase the temperature set point and supply the additional amount of power from the heated rolls to the fuser belt.

The radiant heater is operable to heat the inner surface of the fuser belt during movement of the fuser belt, to increase the temperature of the portion(s) of the fuser belt that come(s) into contact with thick media and/or coated media to a temperature effective to fuse toner on such media. The timing of heating of the inner surface is controllable by the heater controller so that heat can be supplied by the radiant heater to about the length (and width) of the fuser belt that contacts the medium at the nip.

To heat the fuser belt, the radiant heater can be controlled by the heater controller to supply an effective amount of heat to a length of the fuser belt to heat the length of the fuser belt to the desired temperature. The temperature of the fuser belt is typically measured at the outer surface, which contacts media during fusing of toner on the media. The heating of the fuser belt by the radiant heater, when timed to correspond to the process speed of the fuser belt, directly translates to increased thermal energy being supplied to only about the desired process length of the fuser belt. The desired process length can correspond to about the length of a medium in order to provide efficient heating of the fuser belt. For example, this process length can be the distance between points L and T on the fuser belts 220, 320.

In embodiments, the radiant heater can be activated to heat portions of the fuser belt that are brought into contact with successively-printed thick and/or coated media, and then be turned OFF when thin media are then printed.

The radiant heater can heat the selected portion of the fuser belt to the desired higher temperature within the time period that it takes for the selected portion of the fuser belt to travel past the radiant heater. Typically, the portion of the fuser belt can be heated to the desired temperature within about 150 ms or less by the radiant heater. This is the amount of time that it takes for the heat to flow from the inner surface to the outer surface of the belt. For example, the fuser belt 220 shown in FIG. 2, when moving at a belt speed of about 700 mm/s, has about 400 ms of time from the location of the radiant heater 240 to the nip 206. The radiant heater 240 can heat the fuser belt 220 to the desired temperature within this amount of time.

In embodiments, the flash lamps of the radiant heater of the fuser assembly can be triggered simultaneously to heat a first length of the fuser belt facing the radiant heater. For example, in the radiant heater 240, a flash lamp closest to the upstream end 241 (i.e., the upstream-most flash lamp) and the flash lamp closest to the downstream end 243 (i.e., the downstream-most flash lamp) can be separated from each other by a distance of about 70 mm. In other embodiments of the fuser assembly, the downstream-most flash lamp and the upstream-most flash lamp can be separated from each other by about 60 mm to about 120 mm, depending, e.g., on the size of the space between adjacent rolls of the fuser assembly where the radiant heater is located. In embodiments, this separation distance between the upstream-most and downstream-most flash lamps is approximately equal to the effective heating length of the radiant heater. The radiant heater 240 can include reflectors (such as the reflector 570) configured to increase the heating efficiency. Then, the capacitors of the flash lamps can be recharged and triggered simultaneously a second time to heat a second portion of the fuser belt 220 facing the radiant heater 240. To heat a total length of the fuser belt corresponding to about the length of an 8.5 inch×11 inch medium (i.e., a length of about 280 mm), all of the flash lamps can be flashed at the same time. Also, a fraction of the flash lamps can be flashed, followed by another fraction after a pre-set amount of time, in order to spread the energy density over a longer period of time to reduce over-heating. If it is desired to heat a longer portion of the fuser belt for longer media, then flash lamp capacitors can be recharged and flashed a second time for either all of the flash lamps, or a fraction of the flash lamps.

In the fuser assembly 200, the portion of the fuser belt 220 located between the points L and T, which has been heated to the desired temperature by the radiant heater 240, is rotated to the nip 206. The movement of the fuser belt 220 and the feeding of the medium 230 to the nip 206 are timed so that the outer surface 224 of the heated portion of the fuser belt 220 contacts the surface 232 of the medium 230 at the nip 206. Heat conducted from the outer surface 224 of the fuser belt 220 increases the temperature of the medium 230 to the desired temperature for fusing toner on the medium 230. The medium 230 can be thick and/or coated. The amount of heat supplied to the medium 230 by the portion of the fuser belt 220 between endpoints L and T is sufficient to heat the thick and/or coated medium 230 to a temperature effective to fuse the toner.

Embodiments of the fuser assemblies can be used in print jobs for fusing toner on media that are all thick, all coated, or have different thicknesses and optionally are also coated. For example, the fuser assemblies can be used in xerographic apparatuses for print jobs in which all media have the same thickness (e.g., all thick media), some media have different thicknesses, and/or media are coated and un-coated. The fuser assemblies can keep the temperature set point of the fuser belt more uniform by using the radiant heater as a supplemental heat source.

For example, in a mixed-media print job, assuming that the media 230, 330 are thin, to fuse toner on the thin media using the fuser assemblies, 200, 300, respectively, the radiant heaters 240, 340 can be turned OFF, so that the portions of the fuser belts 220, 320 that contact the media 230, 330 at the nips 206, 306 have not been heated by the radiant heaters 240, 340, and are at approximately the temperature set points of the fuser belts 220, 320 when reaching the nip 206, 306. The temperature set points of the fuser belts 220, 320 are reached by supplying heat from the heated rolls to the fuser belts 220, 320. The fuser belts 220, 320 supply sufficient heat to the thinner media 230, 330 in the nips 206, 306, to fuse toner on these media.

Subsequently, to print a thick medium using the fuser assembly 200, or the fusing assembly 300, the respective radiant heater 240, 340 is turned ON to heat a portion of the fuser belt 220, 320 to a sufficiently-high temperature, such that the fuser belts 220, 320 can supply sufficient additional heat to the thick medium at the nip to fuse toner on the thick medium (i.e., heat in addition to the heat supplied to the thin media 230, 330 by the fuser belts 220, 230 when heated only by the heated rolls). Due to having a lower thermal mass than the heated rolls, the radiant heaters 240, 340 can be powered to heat the selected portion of the fuser belts 220, 320 to the desired temperature for heating thick media more quickly, and using less energy, than the fuser belts 220, 320 can be heated to a higher temperature set point corresponding to the desired temperature by increasing the heat output of the heater rolls of the fuser assemblies 200, 300. Due to the relatively large amount of power needed to heat the entire fuser belts 220, 320, especially when the fuser belts 220, 320 have a longer length (e.g., greater than 500 mm) to a higher set point, it is also more energy efficient to heat the portion of the fuser belts 220, 320 with the radiant heaters 240, 340, as compared to increasing the temperature set points of the fuser belts 220, 320 and heating the entire length of the fuser belts 220, 320 to the higher temperature set points with the heated rolls alone. Accordingly, the fuser assemblies 200, 300 can provide improved time and energy efficiency when used for printing thin and thick media, and coated and uncoated media, in the same xerographic apparatus.

Accordingly, embodiments of the fuser assembly, such as the fuser assembly 200 and the fuser assembly 300 can be operated to use the radiant heaters 240, 340 as a supplemental heating device. The radiant heaters 240, 340 can be used to supplement heating of the fuser belts 220, 320 by the heated rolls supporting these fuser belts. For example, the fuser assembly with the fuser belt running at a selected number of pages per minute can consume a first level of power to fuse thin media, and a higher second level of power to fuse thick media. The heated rolls of the fuser assemblies 200, 300 can supply the first level of power, while the radiant heaters 240, 340 can be used to supply the additional amount of power needed to fuse toner on thick media (i.e., the difference between the second level of power and the first level of power) on a rapid, as-needed basis.

In some embodiments, during processing of thick media and/or coated media, in addition to supplying heat to the fuser belt from the radiant heater of the fuser assembly, it may be desirable to also increase the level of power supplied from the heated rolls. This can occur when a substantial amount of heavy-weight media is expected. In such embodiments, the radiant heater is used to provide an additional source of energy only while the whole system is heating up. Once the whole system reaches the desired temperature, the radiant heater does not need to be used to heat the fuser belt.

Another exemplary use of embodiments of the fuser assembly, such as the fuser assemblies, 200, 300, is to provide tunable gloss on media by controlling the fusing set temperature. The flash lamps can be arranged in the radiant heater, have heating capacities and be controlled to operate such that the amount of flashing energy is dependent on the image content. Higher or lower gloss levels can be produced in selected areas of prints. These areas can be near the leading edge, trailing edge, and/or some portion of media. Such gloss level control can be achieved by controlling the radiant heat source in the radiant heater. For example, in the radiant heater 540 shown in FIG. 5, the flash lamps 560A, 560B, 560C can be triggered to supply an energy density to a first portion of the fuser belt, and the flash lamps 560D, 560E, 560F can then be triggered to supply a different energy density to a second portion of the fuser belt, where the first and second portions are used to heat a medium. The capability of varying the gloss on a sheet-to-sheet basis, for example, allows for enhanced customer-controlled output for print jobs.

In other embodiments, the gloss level on media can be controlled by supplying different energy densities to media from different radiant heat sources of the radiant heater. For example, in the radiant heater 540, the amount of energy stored in the capacitor for each of the flash lamps 560A, 560B, 560C, 560D, 560E and 560F can be different, allowing these flash lamps to supply different amounts of energy to the fuser belt when triggered. Also, the ratio of the total number of capacitors to the total number of flash lamps, n, in the radiant heaters can be varied from 1:1 to 1:n. The amount of energy stored in a capacitor is given by the equation: $E=\frac{1}{2} CV^2$, where C is the capacitance of the capacitor, and V is the voltage on the capacitor. The total stored energy in the capacitors for the flash lamps 560A, 560B, 560C, 560D, 560E and 560F can be regulated by controlling the capacitor charge time or the charging voltage. In other embodiments, groups of the flash lamps can supply different amounts of energy than other groups of the flash lamps.

Another exemplary use of embodiments of the fuser assembly, such as the fuser assemblies 200, 300, is to control the temperature of the fuser belt 220, 320 as a function of the image content on media. For example, media with toner images that are primarily or exclusively text, and more easily fused, can be processed at lower fusing temperatures than media (e.g., paper sheets) that have at least one toner image with higher-area coverage. For example, the energy density and the associated discharge for radiant heat supplied to media by the radiant heater 240, 340 can be controlled to control the temperature reached by the outer surface 224, 324 of the fuser belt 220, 320. This use of the fuser assembly can be dictated on a sheet-by-sheet basis.

Embodiments of the fuser assembly, such as the fuser assembly 200 and the fuser assembly 300, can be used for fusing toner in xerographic apparatuses that use oil for reducing offset, as well as in other "oil-less" apparatuses that use toner particles containing a release agent, such as wax, instead of using release oil. The structure and composition of the layers of the fuser belt can be varied depending on whether release oil is used or not used in the apparatus.

EXAMPLES

A first-order thermal model of a fuser assembly including a fuser belt was made. In the model, the fuser belt includes an inner, polyimide layer forming an inner surface; an intermediate, silicone layer on a surface of the polyimide layer opposite to the inner surface; and an outer, Viton® layer on the opposite surface of the silicone layer to inner layer and forming the outer surface of the fuser belt. The thicknesses of these layers are: polyimide layer 80 μm/silicone layer 180 μm/Viton® layer 20 μm. In the model, the fuser belt is heated at the inner surface using a radiant heater. The radiant heater includes the components shown in FIG. 4 with four flash lamps. The energy density, E, supplied by the radiant heater is calculated with equation (1):

$$E=(0.5CV^2\cdot n\cdot f)/v\cdot w. \quad (1)$$

In this equation, C is the capacitance, V is the voltage of the capacitor, n is the number of flash lamps, f is the flash frequency of the flash lamps, v is the speed of the fuser belt, and w is the width of the fuser belt. Inputting the following exemplary numerical values in equation (1): C: 210 μF, V: 808 V, n: 4, f: 8.9 Hz, v: 0.7 m/s, and w: 0.4 m, D equals about 8700 J/m$^2$.

FIG. 7 shows curves formed by calculating the polyimide layer inner surface temperature (♦), the polyimide layer/silicon layer temperature (■), and the Viton® layer outer surface temperature (▲). The maximum temperature reached by the polyimide layer is dependent on the amount of energy provided to the fuser belt by the radiant heater (i.e., the energy density), and the time duration over which the radiant heater supplies this amount of energy to the fuser belt. For the curves shown in FIG. 7, a flash density of about 8700 J/m$^2$ supplied to the fuser belt within 2 ms is assumed. As shown, the inner surface of the polyimide layer reaches a maximum temperature of about 500° C. within 2 ms using these heating conditions.

FIG. 8 shows curves formed by calculating the polyimide layer inner surface temperature (♦), the polyimide layer/silicon layer interface temperature (■), and the Viton® layer outer surface temperature (▲). For the curves shown in FIG. 8, a flash density of about 8700 J/m$^2$ calculated using equation (1) is supplied to the fuser belt within 4 ms. As shown, the inner surface of the polyimide layer reaches a maximum temperature of about 425° C. within 4 ms using these heating conditions. This lower temperature is desirable for the material of the inner layer.

As shown in FIGS. 7 and 8, the Viton® layer outer surface temperature can be increased from about 180° C. to about 193° C. within a period of time of about 100 ms. When operating the fuser assembly at a fuser belt speed of, e.g., 700 mm/s, 100 ms relates to a 70 mm travel distance by the fuser belt. For a fuser belt length of about 1000 mm, for example, 70 mm is acceptable for embodiments of the fuser assembly including a radiant heater.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fuser assembly for a xerographic apparatus, comprising:

a fuser belt including an inner surface and an outer surface opposite the inner surface;

at least a first roll and a second roll supporting the fuser belt, at least one of the first roll and second roll being adapted to heat the fuser belt; and a radiant heater spaced from and facing the inner surface of the fuser belt;

wherein the radiant heater is adapted to emit radiant heat onto the inner surface of the fuser belt to directly heat the inner surface to increase the temperature of the outer surface of the fuser belt opposite the inner surface heated by the radiant heater.

2. The fuser assembly of claim 1, wherein:

the fuser belt has a width and a length perpendicular to the width; and the radiant heater comprises a plurality of flash lamps which extend parallel to each other along the width of the fuser belt, and adjacent ones of the flash lamps are spaced from each other along the length of the fuser belt.

3. The fuser assembly of claim 2, wherein the radiant heater is adapted to emit an energy density of about 2,000 J/m$^2$ to about 12,000 J/m$^2$ onto the inner surface of the fuser belt within a time period of less than 10 ms when the flash lamps are triggered.

4. The fuser assembly of claim 2, further comprising a controller which controls the flash lamps such that at least one of the flash lamps can be triggered to supply heat to the inner surface of the fuser belt at a different time than the other flash lamps.

5. The fuser assembly of claim 2, further comprising a controller which controls the flash lamps such that at least one of the flash lamps can supply a different energy density to the inner surface of the fuser belt than the other flash lamps.

6. The fuser assembly of claim 1, wherein:

the first roll is a fuser roll adjacent a pressure roll, the fuser roll and pressure roll defining a nip to which a medium having toner thereon is fed;

the second roll is an idler roll; and the radiant heater is disposed between the first roll and the second roll along the inner surface of the fuser belt.

7. A xerographic apparatus, comprising:

a fuser assembly according to claim 6; and a media feeding apparatus for feeding a medium having toner thereon to the nip;

wherein the fuser belt is rotatable to bring the outer surface of the fuser belt, opposite the inner surface heated by the radiant heater, into contact with the medium to fuse the toner onto the medium at the nip.

8. A fuser assembly for an imaging system, comprising:

a fuser belt including an inner surface, an outer surface opposite the inner surface, a width and a length perpendicular to the width, the fuser belt having a length of about 500 mm to at least about 1000 mm;

at least a first roll and a second roll supporting the fuser belt; and a radiant heater facing the inner surface of the fuser belt, the radiant heater comprising a plurality of flash lamps which extend parallel to each other along the width of the fuser belt with adjacent ones of the flash lamps spaced from each other along the length of the fuser belt, the flash lamps including an upstream-most flash lamp and a downstream-most flash lamp separated from each other by a distance of about 60 mm to about 120 mm along the length of the fuser belt;

wherein the radiant heater is adapted to emit radiant heat onto the inner surface of the fuser belt to increase the temperature of the outer surface of the fuser belt opposite the inner surface heated by the radiant heater.

9. A fuser assembly for a xerographic apparatus, comprising:

a fuser belt including an inner surface and an outer surface opposite the inner surface;

at least a first roll and a second roll supporting the fuser belt, the first roll and second roll being adapted to heat the fuser belt;

a third roll;

a nip defined between the second roll and third roll; and a radiant heater spaced from the inner surface of the fuser belt, the radiant heater including a plurality of flash lamps facing the inner surface between the first roll and second roll;

wherein the flash lamps are adapted to emit radiant heat onto the inner surface of the fuser belt to directly heat the inner surface to increase the temperature of the outer surface of the fuser belt opposite the inner surface heated by the flash lamps.

10. The fuser assembly of claim 9, wherein:

the fuser belt has a width and a length perpendicular to the width; and the flash lamps extend parallel to each other along the width of the fuser belt, and adjacent ones of the flash lamps are spaced from each other along the length of the fuser belt.

11. The fuser assembly of claim 10, further comprising a controller which controls the flash lamps such that at least one of the flash lamps can be triggered to supply heat to the fuser belt at a different time from the other flash lamps.

12. The fuser assembly of claim 10, further comprising a controller which controls the flash lamps such that at least one of the flash lamps supplies a different energy density to the inner surface of the fuser belt than the other ones of the flash lamps.

13. The fuser assembly of claim 10, wherein:

the flash lamps include an upstream-most flash lamp and a downstream-most flash lamp separated from each other by a distance of about 60 mm to about 120 mm; and the fuser belt has a length of about 500 mm to at least about 1000 mm.

14. The fuser assembly of claim 10, wherein:

the second roll is a fuser roll adjacent a pressure roll, and the fuser roll and pressure roll define the nip to which a medium having toner thereon is fed;

the first roll is an idler roll; and the radiant heater is disposed between the first roll and second roll.

15. A xerographic apparatus, comprising:

a fuser assembly according to claim 14; and a media feeding apparatus for feeding a medium having toner thereon to the nip;

wherein the fuser belt is rotatable to bring the outer surface of the fuser belt opposite the inner surface heated by the radiant heater into contact with the medium to fuse the toner on the medium at the nip.

16. The fuser assembly of claim 9, wherein the flash lamps are adapted to supply an energy density of about 2,000 J/m$^2$ to about 12,000 J/m$^2$ onto the inner surface of the fuser belt within a time period of less than 10 ms when the flash lamps are triggered.

17. A method of fusing toner onto a medium in a xerographic apparatus comprising at least a first roll and a second roll supporting a fuser belt including an inner surface and an outer surface opposite the inner surface, at least one of the first roll and second roll being adapted to heat the fuser belt, the method comprising:

heating at least a portion of the inner surface of the fuser belt using a radiant heater spaced from the inner surface that emits radiant heat onto the inner surface to directly heat the inner surface; and contacting a first medium having a first toner thereon with a portion of the outer surface of the fuser belt opposite the portion of the inner surface heated by the radiant heater so as to heat the first toner to a first temperature effective to fuse the first toner onto the first medium.

18. The method of claim 17, further comprising, prior to or subsequent to the heating of at least the portion of the inner surface of the fuser belt, contacting a second medium having a second toner thereon with a portion of the outer surface of the fuser belt opposite a portion of the inner surface that has been heated exclusively by at least one of the first roll and the second roll supporting the fuser belt so as to heat the second toner to a second temperature effective to fuse the second toner onto the second medium.

19. The method of claim 17, further comprising, prior to or subsequent to the heating of at least the portion of the inner surface of the fuser belt, contacting an uncoated second medium having second toner thereon with a portion of the outer surface of the fuser belt opposite a portion of the inner surface that has been heated exclusively by at least one of the first roll and the second roll supporting the fuser belt so as to heat the second toner to a second temperature effective to fuse the second toner onto the second medium.

20. The method of claim 17, further comprising:

controlling the temperature of the portion of the outer surface of the fuser belt opposite the portion of the inner surface heated by the radiant heater so as to control a gloss of an image on the first medium; or controlling the temperature of the portion of the outer surface of the fuser belt opposite the portion of the inner surface heated by the radiant heater based on an image content on the first medium.

* * * * *